US010384252B2

(12) United States Patent
Sachdev et al.

(10) Patent No.: US 10,384,252 B2
(45) Date of Patent: Aug. 20, 2019

(54) WARM FORMING OF WORK-HARDENED SHEET ALLOYS

(71) Applicant: GM GLOBAL TECHNOLOGY OPERATIONS LLC, Detroit, MI (US)

(72) Inventors: Anil K. Sachdev, Rochester Hills, MI (US); John T. Carter, Farmington, MI (US); Raja K. Mishra, Shelby Township, MI (US); John E. Carsley, Oakland, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 212 days.

(21) Appl. No.: 15/114,955

(22) PCT Filed: Feb. 17, 2015

(86) PCT No.: PCT/US2015/016127

§ 371 (c)(1),
(2) Date: Jul. 28, 2016

(87) PCT Pub. No.: WO2015/123663

PCT Pub. Date: Aug. 20, 2015

(65) Prior Publication Data

US 2016/0339497 A1 Nov. 24, 2016

Related U.S. Application Data

(60) Provisional application No. 61/940,662, filed on Feb. 17, 2014.

(51) Int. Cl.
*B21D 22/02* (2006.01)
*B21D 53/88* (2006.01)
(Continued)

(52) U.S. Cl.
CPC ..... *B21D 22/022* (2013.01); *B21D 53/88* (2013.01); *C22F 1/04* (2013.01); *C21D 1/673* (2013.01)

(58) Field of Classification Search
CPC ..... B21D 22/02; B21D 22/022; B21D 24/16
See application file for complete search history.

(56) References Cited

U.S. PATENT DOCUMENTS

2002/0162877 A1 11/2002 Dziadosz et al.
2007/0163685 A1 7/2007 Kusumi et al.
(Continued)

FOREIGN PATENT DOCUMENTS

JP 2010156024 A 7/2010
JP 2013049077 A 3/2013

OTHER PUBLICATIONS

Written Opinion of the International Searching Authority and International Search Report for application No. PCT/US2015/016127; 9 pages.

*Primary Examiner* — Debra M Sullivan
(74) *Attorney, Agent, or Firm* — Reising Ethington P.C.

(57) ABSTRACT

Methods suitable for forming complex parts from work-hardened sheet materials of limited formability are described. The formability of the work-hardened sheet is enhanced by forming at elevated temperature. The forming temperature is preferably selected to minimally undo the effects of work hardening so that the formed part is of higher strength than a like part formed from an annealed sheet. The method is applicable to age-hardening and non-age-hardening aluminum and magnesium alloys.

7 Claims, 3 Drawing Sheets

(51) Int. Cl.
*C22F 1/04* (2006.01)
*C21D 1/673* (2006.01)

(56) References Cited

U.S. PATENT DOCUMENTS

| | | | | |
|---|---|---|---|---|
| 2009/0234385 | A1 | 9/2009 | Cichocki et al. | |
| 2010/0218860 | A1* | 9/2010 | Dorr | C21D 1/34 148/695 |
| 2013/0127197 | A1* | 5/2013 | Diersmann | B21D 22/00 296/1.08 |
| 2015/0224558 | A1* | 8/2015 | Sachdev | B21D 22/022 72/38 |
| 2016/0340766 | A1* | 11/2016 | Steinebach | C22F 1/04 |

* cited by examiner

WARM FORMING OF WORK-HARDENED SHEET ALLOYS

CROSS-REFERENCE TO RELATED APPLICATION

This application claims the benefit of U.S. Provisional Application No. 61/940,662 filed Feb. 17, 2014, entitled "Warm Forming of Work-Hardened Sheet Alloys", the entire contents of which are hereby incorporated by reference.

TECHNICAL FIELD

The technical field of this disclosure relates generally to the warm forming, by stamping, of work-hardened light metal alloy sheet, particularly aluminum alloy sheet, into shapes appropriate for use as body panels or structural members in vehicles.

BACKGROUND

Automobile and light truck bodies and structural elements are commonly formed from sheet metal components which may range in thickness from about 0.65 millimeter for outer body panels and up to about 6 millimeters for frame rails. Each component will comprise combinations of features, such as depressions, radii etc. as dictated by structural or aesthetic considerations, or both. These components are generally shaped by stamping, that is, an incoming flat sheet obtained from a supplier is placed between a pair of dies of complementary shape and the dies are closed on the sheet to impart the desired shape to the sheet.

The dies are positioned in a press, which may be mechanical or hydraulic, which alternately opens and closes the dies to both stamp the component and enable feeding of the incoming flat sheets and removal of the stamping. A process cycle, feed-stamp-remove, for a large automotive stamping, such as a decklid, may be about 6-10 seconds. It should be noted that the stamping operation only imparts the intended three-dimensional shape to the intended part. Further operations, such as trimming to remove excess material, or punching to create openings are generally required to generate a finished part or component ready for assembly into a vehicle.

In the course of forming the component, the incoming sheet metal is deformed by an amount necessary to form the depressions, radii etc. required by the part design. The extent of the required deformation may be related to the geometry of individual features in the component, such as the depth of depression or the sharpness of a radius, or, in complex parts, by the interplay of the deformations required to produce a plurality of features. An attempt to form such a complex part may result in the sheet metal fracturing, splitting or tearing if the required deformation exceeds the capabilities of the sheet metal.

Sheets of lesser ductility are generally less formable and more prone to result in stampings with tears and splits than are sheets of greater ductility. For example, the forming severity of bends may be correlated with the R/T ratio for such bends, where R is the radius of the bend and T is the thickness of the sheet. Gentle curvature bends, such as 20T or greater, may be formed without undue difficulty. Often however, it is desired to form much sharper or 'crisper' features in a panel which may require 1T to 8T bends. Such small radius bends present more challenges to forming a part, particularly in materials of lesser formability. This may produce a disconnect between the desired complexity of the component and the ductility required of the incoming sheet metal to successfully stamp the component. Historically, this situation has been resolved by using sheet metal in its most soft, fully annealed condition, since this material will exhibit the greatest ductility. Of course, in consequence, the stamped component will be of minimum strength.

With the ongoing need for increased vehicle fuel economy, there is continuing interest in using higher strength-to-weight ratio materials. One effective approach to transition to higher strength-to-weight materials is to substitute materials of lesser density for materials of higher density, e.g. aluminum alloys for steel, and magnesium alloys for aluminum alloys. However after the initial benefit resulting from such substitution has been obtained, further improvement can only be achieved by increasing the strength, particularly the yield strength, of the alloys. As noted above, increased strength is commonly associated with reduced ductility so that improving the strength of an alloy can reduce its formability and so render it less suitable for stamping parts with complex features.

This reduction in formability with alloy strength is generally observed, but is particularly evident when strengthening results from work-hardening arising from cold-forming, that is, plastic deformation conducted 'cold', or for aluminum and magnesium alloys, at or about ambient temperature or 20-25° C.

There is thus a need for forming complex parts of higher strength materials.

SUMMARY OF THE DISCLOSURE

The methods of this invention enable the forming of relatively thin, work-hardened sheets of light metal alloys into strong three-dimensional articles of manufacture. For example, relatively thin, cold-rolled sheets (e.g., 0.65 mm to 6 mm in thickness) of suitable aluminum alloys, or of magnesium alloys, may be shaped in a single operation into complex, three-dimensional shapes such as those required in the manufacture of body panels or frame members for today's automotive vehicles. Such shaped articles are formed starting with a work-hardened, flat sheet which is briefly heated to a warm forming temperature, and then immediately stamped. That is, the sheet is shaped by being closed between unheated, complementary dies of suitable shape.

The article is required to have a specified three-dimensional shape, a suitable thickness, and certain minimum yield strength requirements. A suitable aluminum alloy sheet material or magnesium alloy sheet material is selected, based on the required properties of the formed article and the response of the alloy to the intended series of processing steps. A flat sheet of the metal alloy is obtained having a two dimensional shape suitable for placing between the opposing shaped dies for forming in one step into a three-dimensional stamping which is a precursor shape of the intended article.

A step in the preparation of the light metal alloy sheet material is a cold rolling step that provides the sheet with a thickness suitable for forming the desired part while also work-hardening or strengthening the sheet. It is desired that the yield strength of the selected, cold rolled sheet be greater than the desired minimum yield strength of the part.

The cold rolled sheet is then rapidly heated to a warm forming temperature and maintained at that temperature at least until the sheet attains a uniform temperature. The duration of the heating period and the warm forming temperature are pre-determined so as to enable the forming of the sheet into an acceptable part. The goal of the heating is to temporarily soften the sheet for the one-step forming operation between unheated die members while maintaining a determined proportion of the work-hardened strength in the heated blank. The heated blank is then promptly placed between the unheated dies, and formed into the three-dimensional shape. During forming, it is anticipated that some cooling of the blank may occur due to thermal communication of the heated blank with the unheated dies. As soon as the desired shape in the metal sheet has been attained (within a period of seconds), the dies are separated and the stamping carefully removed. The stamping may then be further cooled in ambient air to a temperature for further processing, such as trimming of peripheral sheet material, punching of holes etc. to render the desired part of component.

Heating of work-hardened alloys has the ability to recrystallize the alloy, or stated differently, to undo the effects of work-hardening and restore the alloy to its soft, annealed condition. Recrystallization, and softening of the work-hardened alloy, occurs progressively, and the extent of recrystallization will depend on both temperature and the time the sheet is held at temperature. It is an intent of the practices of this invention to select a forming temperature and/or to limit the length of time the sheet is exposed to the forming temperature to limit recrystallization and limit any loss of strength during heating and forming. And to thereby retain an appreciable portion of the work-hardened strength in the stamping.

But the critical features of this forming method include obtaining suitable mechanical properties in the cold rolled, sheet metal alloy blank, briefly heating the blank to a uniform temperature and thereby softening the sheet metal for its required degree of forming, and promptly forming the heat-treated sheet between unheated dies to maintain required yield strength values in the identified regions of the formed part. In accordance with practices of this invention, work-hardened light alloy sheet workpieces, typically based on magnesium and aluminum, are used in a warm forming stamping step to shape articles, such as automotive body panels, having complex three-dimensional shapes.

DETAILED DESCRIPTION

Figure 1:
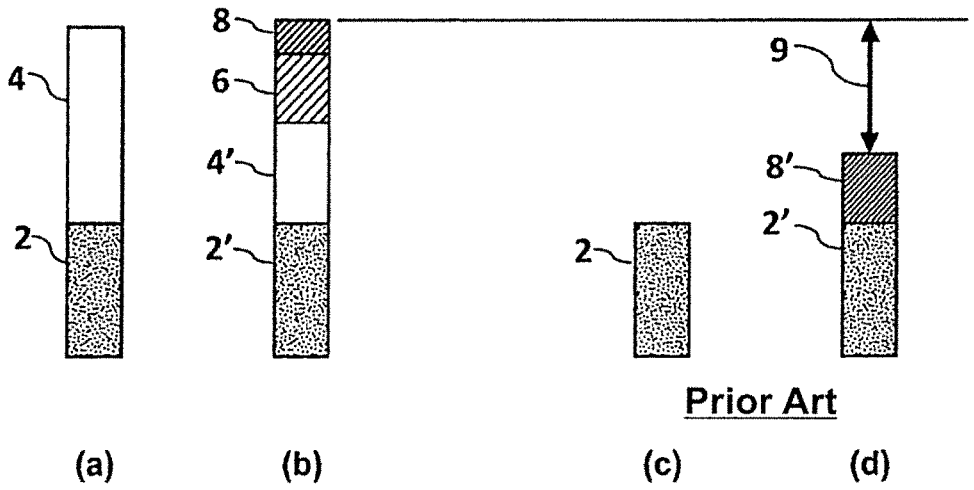
FIGS. 1*a-d* schematically illustrate and compare the yield strength and strengthening contributions obtained when forming a cold rolled, age-hardening alloy composition at a temperature less than the process recrystallization temperature with the strength and strengthening contributions obtained with a conventionally stamped alloy.

The methods detailed in this description resolve several challenges encountered in producing high strength formed parts by forming stamped articles exhibiting complex shapes from light metal alloy sheets, and particularly aluminum alloy sheets, strengthened by work-hardening. Such sheets are usually cut from a longer length of sheet metal rolled into a coil and are commonly called blanks.

Aluminum alloy sheet is typically processed by subjecting a slab, which may range from 150-600 millimeters or so thick, to a sequence of multiple rolling operations, each of which will reduce the slab thickness by some predetermined amount. The first rolling operations are typically performed 'hot', that is, at elevated temperatures which induce no work-hardening. Later rolling operations, and particularly the final rolling operation, are performed 'cold' and a work-hardened sheet results. The sequence of rolling operations may be managed to develop substantially any desired strength in the cold rolled sheet by managing the degree of reduction required to achieve the specified sheet thickness in the final cold rolling step. The greater the reduction, the greater the hardness and the less the formability of the cold rolled sheet.

The forming or stamping capabilities of incoming sheet metal is generally termed 'formability'. Formability is related to the ability of the sheet blank to accommodate strains in the plane of the sheet sufficient to enable a desired part geometry. Such strains may be expressed as the magnitudes of two mutually-orthogonal principal strains in the plane of the sheet. The directions of these principal strains are usually not related to the sheet orientation.

While there is no universally-accepted formability metric which is applicable to all stampings, one test procedure which has support is the Limiting Dome Height Test (LDH). The LDH procedure advances a hemispherical punch into a sheet under test to form the initially-flat sheet into a dome. This continues until the sheet fractures at some dome height which characterizes the maximum, or limiting, distance the punch may be extended into the sheet. The greater the limiting dome height, the greater the formability of the sheet.

To obtain the elevated temperature LDH test results reported later, a test sheet was heated to temperature, held at temperature for 5 minutes and then transferred to the LDH tester. The LDH tester used a matching pair of heated dies to clamp the sheet around its periphery and induce a state of biaxial stretch when the sheet was deformed by advancing a heated 101.6 millimeter diameter hemispherical punch into the test sheet at a rate of 1 mm/second.

Formability may also be generally correlated with, and inferred from, the ductility of the sheet, as measured in a tensile test in which a sample is pulled to failure along an axis. This is a less rigorous measure of formability, but tensile tests are easier to conduct than LDH tests, and so tensile data is often more readily available. Specifically, the total elongation, or the maximum elongation to which the sample may be subjected prior to failure, expressed as a percentage, is used as a measure of ductility.

It is also known that when work-hardened metals, such as cold rolled sheets, are 'annealed', that is, exposed to a suitably-elevated temperature for a suitable time, the work-hardening may be undone and the metal restored substantially to its original strength and ductility. When in this annealed condition magnesium and aluminum alloys are described as being in an 'O' temper. The temperature at which the annealed properties are restored after a one hour exposure to the temperature is the recrystallization temperature. Of course, such annealing, while it restores formability, reduces the blank strength.

To enhance formability, conventionally-processed aluminum alloy sheet is usually annealed after cold rolling. Oftentimes it is desired to fully undo the effects of cold rolling and work-hardening and restore the aluminum alloy to its 'O' temper, however, partial annealing, which retains some portion of the work-hardened strength, but at the expense of reduced formability improvement, is also practiced.

The methods detailed in this description are intended to reduce the tension between formability and part strength resulting from stamping work-hardened light alloy sheets. The methods are particularly directed to the forming of complex sheet metal stampings from aluminum alloy sheets, strengthened by work-hardening.

In practice of the invention the sheet should be uniformly work-hardened. Although sheets may be deformed individually, it is preferred to use the cold-rolled sheet directly, without intermediate anneal, to take advantage of the work-hardening imparted by the cold rolling process. This offers not only economic advantage by eliminating the need for an annealing process, but also a process advantage. Cold working by rolling will promote uniform deformation along the length of the coil from which the sheet is cut. Thus, not only will individual sheets or blanks be uniformly work-hardened but consistency of the (stamping) process conditions may be maintained over a reasonable production run, as each blank cut from the coil will have been work-hardened substantially equally.

The sheet may also be subjected to a partial anneal, which will reduce its strength without fully restoring it to the 'O' temper, if the sheet strength, as-rolled, is incompatible with the formability requirements of the sheet, or the strength requirements of the intended stamped part, as described further below. Preferably however, the rolling schedule may be selected to develop the desired temper in a coil of suitable thickness without any need for an intermediate anneal.

Because a work-hardened alloy, if unloaded and then reloaded, will begin to plastically deform on reloading only when the applied stress equals or exceeds the terminal flow stress achieved on the first loading, a work-hardened alloy will always be stronger than a counterpart undeformed, annealed, alloy. One consequence of forming an article from a previously work-hardened sheet is to increase the yield strength of the formed part. But, such a work-hardened alloy will have reduced formability, that is, a reduced capability to be shaped into a complex part without tearing or splitting.

The ductility or formability of aluminum and magnesium alloys is increased at moderately elevated temperatures, typically from 150° C. to 300° C., relative to the formability of those alloys at ambient temperatures of about 20-25° C. or so. Thus, shaping a work-hardened blank into a stamped article at such temperatures, a process usually described as warm forming, may enable stamping of articles with more complex shapes than is feasible at ambient temperature. This ability of warm forming to more readily stamp complex shapes may be particularly beneficial in previously-work-hardened alloy sheet which inherently exhibits reduced ductility.

A goal of the forming methods of this disclosure is to repeatedly form strong, complex, stamped articles having significant curvature in each of their three dimensions, and often including portions of the product with radii of curvature of eight millimeters or less. The forming of the product shape is accomplished in a single stamping step. Blanks, generally flat, are cut from a coil of flat rolled material into simple rectangular or trapezoidal shapes or die-cut into more varied geometries. The starting sheet material is preferably cold worked or work-hardened, so that it exhibits a yield strength greater than would be obtained from a material of like composition in its annealed condition.

Any of the commercial aluminum-based alloy families may be used. Such alloys are commonly identified the letters AA (for Aluminum Association) followed by a four digit code, the first digit of which identifies the primary alloying elements. It is common to describe aluminum alloy 'series' based on this first digit, and some specific suitable alloy series available in sheet form include AA1XXX (substantially unalloyed and containing at least 99% by weight of aluminum), AA5XXX (alloyed with magnesium), AA6XXX (alloyed with magnesium and silicon), 2XXX (alloyed with copper) and AA7XXX (alloyed with zinc). The remaining 3 digits identify the specific proportions of alloying elements which distinguish individual members. For example, alloy AA6111 (nominal composition, by weight: 0.5-0.9% Cu; 0.5-1.0 Mg; 0.1-0.45% Mn; 0.6-1.1% Si; balance Al and common impurities) is an example of an AA6XXX series alloy.

Aluminum alloys are typically grouped into one of two categories—age hardening alloys, which include AA2XXX, AA6XXX and AA7XXX series alloys, and non-age-hardening alloys which include AA1XXX and AA5XXX series alloys. As noted above, the invention may be practiced on aluminum alloys of all alloy series, both age-hardening and non-age-hardening.

The strength of non-age-hardening aluminum alloys may be designated by a temper designation such as the 'O' temper described earlier. Work-hardened aluminum and magnesium alloys are most commonly indicated by a 3 character identifier beginning, in all cases, with the letter 'H' (Hardened). The second character indicates the procedure followed in hardening the alloy, with 1 indicating simple cold working, 2 indicating cold working followed by an anneal sufficient to partially undo the work-hardening and 3 indicating cold working followed by a low temperature heat treatment, typically at between 120° C. and 175° C., sufficient to stabilize the work-hardened strength without causing reversion of an alloy to its annealed or 'O' condition. The degree of hardening is indicated by the third character typically ranging from 1 to 8 with 1 indicating the lowest strength and 8 the highest. Importantly, tempers designated with a like third character have the same strength. That is, the strength of an H12 alloy is the same as that of an H22 or H32 alloy and the strength of an H16 alloy is the same as that of an H26 and H36 alloy and so on.

Although strengthening may occur at any stage in the process of forming a stamping, it is most convenient to impart the work-hardening to all of the sheet metal in the coil from which the blank is cut by managing the rolling process. Particular sheet reductions may be associated with particular hardness levels. For example, in aluminum alloys, the H18 temper is normally associated with a reduction in thickness of about 75%, H16 with a reduction in thickness of between 50-55%, H14 with a reduction in thickness of about 35% and H12 with a reduction in thickness of between 20-25%.

Because the age-hardening alloy series may be strengthened by heat treatment, strengthening by work-hardening is not commonly practiced with these alloys. However these age-hardening alloys are subject to the same hot and cold rolling practice applied to non-age-hardening alloys and so practice of this invention is equally applicable to age-hardening alloy series. The methods and examples provided are therefore intended to teach their application to all aluminum alloys in particular, and to all light metal alloys, including magnesium-based alloys, in general.

A starting light metal, alloy sheet material is selected. The selected aluminum or magnesium alloy will be work-hardened to provide a starting material which, after stamping, will render a desired strength in the stamped product, part or component, but possess sufficient formability to be stamped into the desired part at a suitably elevated forming temperature. When multiple candidate alloys will satisfy these requirements, the selected alloy will commonly be that alloy which, when stamped, results in the highest strength part. However, other constraints may guide the selection of the particular alloy selected. Exemplary constraints may include, without limitation, corrosion compatibility of adjacent dissimilar alloys, or welding issues, for example, those which may occur when joining aluminum alloys to magnesium alloys.

The starting sheet material is preheated to a predetermined forming temperature just before it is to be placed between opposing stamping dies for the forming operation. In accordance with practices of this invention, the forming temperature of the sheet material is determined for the forming of the intended product shape and by the metallurgical properties of the work-hardened starting material.

The strategy is to preheat the starting material to a temperature that will enhance the formability of the work-hardened alloy for making a specific product shape while retaining much of the strength attributable to work-hardening in the formed product after it has cooled from its specific stamping operation. When placed in service, a part prepared from such a stamping will be able to accommodate higher stresses before undergoing plastic deformation and so exhibit a higher strength to weight ratio with attendant beneficial effects on vehicle performance.

It is preferred to conduct forming using unheated dies. Hence the forming operation should be conducted over a relatively short duration (typically up to a few seconds) to minimize heat loss from the workpiece to the dies during forming. Suitably the dies may be mounted in mechanical presses which enable rapid closure of the dies and shaping of the blanks, but any appropriate fast-acting press may be used.

Of course, it will be appreciated that the heating of the work-hardened blank, although conducted for purposes of enhancing formability, will also heat treat the blank and reduce the strength of the blank and the finished part. Accordingly, the combination of the determined preheat temperature for a specific workpiece of specific thickness and the duration of the warm forming temperature excursion are preferably managed so that the formed product has a yield strength preferably equal to, or greater than, one and one-quarter times the yield strength of the alloy in an annealed, soft condition.

The determination of a useful warm forming temperature may be determined by modeling, experiment, or experience, or any combination of these. The determined warm forming temperature may be specific to a particular work-hardened alloy sheet material, the shape of the product to be produced, and the duration of the heating required for at least developing a uniform temperature in the sheet material before forming and cooling of the product. Each formed part should satisfy the intended strength properties with due allowance for part-to-part strength variation which may result, for example, from variation in the work-hardened structure of the starting workpieces and/or temperature variations in the heating oven.

In a first illustrative example consider the forming of a work-hardened AA5083 (nominally containing, by weight, 0.4-1.0% Mn, 4-4.9% Mg, balance aluminum and unavoidable impurities), a non-age-hardening alloy in H18 temper cold rolled to a thickness of 1.4 millimeters. Such a sheet has been work-hardened to substantially the limits of its ductility so that even minimal further deformation at ambient temperature will rapidly lead to failure of the sheet. Here hardness (HRB), based on the Rockwell 'B' scale and measured at ambient temperature, is used as a surrogate for strength with increasing hardness numbers indicating increasing strength. Data shown in Table 1 illustrate the limiting dome height (in millimeters) measured in an LDH test after heating test sheets of an AA5083-H18 alloy to a series of elevated temperatures and holding them at temperature for 5 minutes before testing. The hardness response of like sheets heated to the same temperatures is shown after 5 minutes, corresponding to the LDH test conditions, and also after 15 minutes exposure to those temperatures.

As shown in Table 1, AA5083 H18 initially has a hardness of about 63 HRB compared to a hardness of about 36 HRB for the same alloy in its annealed state or 'O' temper. Those of skill in the art will appreciate that there will be some variability in hardness results obtained on testing nominally identical samples. This variability may be up to ±1.5 HRB. On annealing the H18 alloy for five minutes at temperatures of up to 300° C. the hardness initially decreases slowly with increasing annealing temperatures, decreasing to about 58 HRB, at an annealing temperature of 250° C. But, with further increase in annealing temperature the hardness drops substantially, for example to about 34 HRB at an annealing temperature of 300° C. The formability, however, as shown by the LDH (Limiting Dome Height) measurements, increases with increasing annealing temperature and even shows a pronounced, and unexpectedly large, maximum at 250° C. In fact, the LDH of the H18 temper 5083 alloy at 250° C. (46.9 millimeters) is greater than the LDH of the 'O' temper 5083 alloy, likewise tested at 250° C., which results in an LDH of 38.7 millimeters.

Thus the 5083-H18 sheet, if heated to 250° C. and stamped has sufficient formability to be formed into a complex shape while maintaining a significant portion of its work-hardened strength provided the 250° C. exposure is limited to about 5 minutes. Further, these strength retentions are not markedly reduced even if an extended annealing time of 15 minutes is used. Thus the process is robust to unavoidable minor increases in heating time such as might result during implementation in an industrial environment.

TABLE 1

| Material and temper with annealing temperature in parentheses | Dome Height (mm) | Hardness after 5 minute anneal (HRB) (LDH test conditions) | Hardness after 15 minute anneal (HRB) |
|---|---|---|---|
| AA5083 H18 (No anneal) | | 63 | |
| AA5083-H18 (100° C.) | 25.4 | | |
| AA5083-H18 (150° C.) | 30.4 | | |
| AA5083-H18 (175° C.) | | 62 | |
| AA5083-H18 (200° C.) | 36.3 | 62 | 61 |

TABLE 1-continued

| Material and temper with annealing temperature in parentheses | Dome Height (mm) | Hardness after 5 minute anneal (HRB) (LDH test conditions) | Hardness after 15 minute anneal (HRB) |
|---|---|---|---|
| AA5083-H18 (225° C.) | 36.9 | 59 | 59 |
| AA5083-H18 (250° C.) | 46.9 | 58 | 56 |
| AA5083-H18 (300° C.) | 37.5 | 34 | 36 |
| AA5083-O (20° C.) | | 36 | |
| AA5083-O (250° C.) | 38.7 | | |

In a second illustrative example, consider the response of a 1.1 millimeter thick, age-hardenable alloy AA6061, heavily cold worked, by cold rolling, to a condition equivalent to an H18 temper. Again the sheets were heated to a test temperature, held at temperature for 5 minutes and then tested. The results of Table 2 show the test temperature, the maximum or limiting dome height, the yield strength of the alloy after this 5 minute high temperature exposure, and, for comparison, the HRB hardness of these same alloys after heating. As shown in Table 2, this heavily cold-worked AA6061 alloy exhibits a minimal dome height in the LDH test when formed, after holding at temperature

TABLE 2

| Dome Forming Temperature (° C.) | Dome Height (mm) | Yield Strength (MPa) | Hardness after Forming (HRB) |
|---|---|---|---|
| 100 | 14.7 | 307 | 58 |
| 150 | 15.3 | 293 | 58 |
| 200 | 17.8 | 284 | 54 |
| 250 | 21.8 | 246 | 47 |

for 5 minutes, at temperatures of 100° C. and 150° C. Even after heating to these temperatures, the yield strength of the alloy remains at about 300 MPa indicating minimal loss of strength. Some improvement in dome height results from forming at 200° C. with significant improvement in dome height observable at 250° C. The dome height at 250° C. is nearly 50% greater than the dome height obtainable when forming at 100° C. Moreover, this improvement in formability is obtained while maintaining a yield strength of 246 MPa, a reduction relative to the 100° C. yield strength of less than 20%. By way of comparison, a fully-aged AA6061-T6 alloy, that is, an AA6061 alloy in its maximum strength condition, exhibits a typical yield strength of about 276 MPa. Since, as detailed later, a production warm-formed work-hardened stamping is expected to age during the process of setting an automobile's paint, the warm-formed, work-hardened AA6061 stamping, after such aging, may be expected to match or exceed the strength of an AA6061-T6 alloy.

In particular, the disclosed methods relate to forming work-hardened aluminum alloy sheets or blanks, such as AA6061, at temperatures greater than ambient temperature and sufficient to enable improved formability while retaining a substantial portion of the strength attributable to the prior work-hardening in the stamped article and so in the formed part. Retention of any portion of the work-hardening strength contribution of the sheet in the formed part will result in a part with greater yield strength than a like part formed from a sheet of like composition in its annealed condition.

In subsequent sections of this disclosure, the term 'strength' refers to the yield strength of the stamped article or formed part at ambient temperature of between about 20° C. and 25° C. The yield strength is the stress which induces plastic or irrecoverable strain in the part or sheet and is readily determined using a tensile test, in which a suitably shaped specimen is pulled to failure.

More particularly, in practice of the invention, a substantially uniformly work-hardened aluminum alloy sheet or blank is first heated to a forming temperature, greater than ambient temperature. The forming temperature is selected to be such as to promote greater ductility than is available at room temperature so that the sheet may be formed into a stamped article of some suitable complexity. Stamping is performed using complementary, often lubricated, unheated, dies mounted in a mechanical press so that the forming process may be conducted at high strain rate to minimize loss of heat from the sheet to the dies. The stamped article may then be removed from the dies and allowed to cool. Typically, cooling will occur naturally in substantially still air, but forced air cooling or cooling by application of a liquid spray composition may also be practiced. If appropriate, the article, or part, may also be maintained between the closed dies to promote rapid cooling. The shaped article may then be subjected to whatever further processing is necessary to develop a finished part, for example, trimming, punching and the like.

Recrystallization was described previously as a process which undoes the effects of cold working and restores the material properties to those obtained when the material is in an undeformed state. Recrystallization occurs at elevated temperatures and progressively over time, gradually reducing the strength of a metal or alloy while simultaneously increasing its ductility. As described earlier, published values of recrystallization temperature, by convention, are based on a time at temperature of one hour. But because recrystallization is a thermally activated process the recrystallization temperature and the recrystallization time are inversely related. Thus the recrystallization temperature for shorter heating times, of say 5-10 minutes, will be greater than handbook or published values. It is anticipated that the process time, including heating and forming time, for the practice of this invention will be less than 10 minutes. The heating/forming temperature at which recrystallization (i.e. complete reversal of the effects of work-hardening) occurs during practice of this invention will be termed the process recrystallization temperature to distinguish it from the conventional recrystallization temperature based on exposure to temperature of one hour. Since the process recrystallization temperature corresponds to the temperature which, over the duration of the heating and stamping process, will fully recrystallize the alloy, the forming temperature will preferably be selected to be less than the process recrystallization temperature.

Further, the recrystallization temperature also depends on the extent of cold work. Heavily cold worked, or work-hardened, metals and alloys, for example H18 temper alloys, recrystallize more readily than lightly work-hardened metals and alloys, for example H12 temper alloys. Hence the recrystallization temperature for a heavily cold worked metal or alloy will be lower than the recrystallization temperature for a lightly cold worked metal or alloy of identical composition. A similar effect is observed for the process recrystallization temperature.

Stamping may be conducted with or without the use of lubricant. If lubricant is used, it is preferred that the lubricant be compatible with downstream processing such as welding and painting or readily removable after stamping so that minimal effort need be expended to clean off excess lubricant. One suitable approach is described in commonlyassigned, co-pending application Ser. No. 14/174,888 which is herein incorporated by reference.

The required forming requirements which must be satisfied by a selected aluminum alloy may be determined through computer modeling, experiment, or experience, or any combination of these approaches. If the die geometry is known, a digitized representation of the die geometry, as well as the lubrication conditions, may be input to a finite element (FE) based forming model to determine the strains produced in a sound, split-free stamped article. Knowledge of the maximum strains in the modeled stamped article may then be used, typically in conjunction with forming limit diagrams (FLDs) or the like for specific alloys in specific tempers, to assess the forming severity of the part. This forming severity evaluation is then used to guide selection of an appropriate aluminum alloy and forming temperature as detailed below. In some cases, where physical dies have already been produced, the above process can be substantially physically reproduced, by using a high formability alloy and the lubricant of choice to again map out the resulting strains for guidance in alloy and forming temperature selection. Such modeling or experimental approaches are well known to those skilled in the art.

With knowledge of the forming conditions, an alloy and forming temperature selection appropriate for the forming severity of the part in question may be selected. Such a temperature and alloy may be determined from predetermined relationships between the formability of any of a range of aluminum alloys intended for use and the forming temperature. The procedure should also comprehend the temper of the alloys. Suitable approaches may include, for example, comparing the expected strains in the formed part with forming limit diagrams (FLDs) for candidate alloys and tempers. The formed part strains should not exceed the failure strains, and, more preferably should not exceed strains in the safe zone of the FLD for a particular alloy and temper under consideration at a forming temperature of interest.

Where modeled data are available, permitting modeling of the part stresses as well as strains, a stress-based approach using stress-based forming limit diagrams (FLDs) may be superior to a strain-based approach. It will be appreciated that the forming of a cold rolled sheet will result in a change of strain path, possibly rendering a stress-based analysis more suitable. Of course, if it desired to use a specific alloy for compatibility with abutting parts, or for economic reasons, investigation of the forming relationships may be limited to only a specific alloy.

Once the alloy and the forming temperature have been selected, the temper of the sheet may be determined. The intent is always to retain sufficient work hardening contribution after warm forming to maintain part strength greater than the strength of the alloy in its 'O' temper. Preferably, the part should exhibit a strength of at least one and one-quarter the strength of the alloy in its 'O' temper with yet higher strength being more preferred. However, it should be noted that even if the work hardening is fully undone by the warm forming and the part strength is no greater than if stamping had been conducted using an 'O' temper alloy there may still be some benefit ascribable to warm forming due to the elimination of the step of annealing the cold rolled sheet.

This preferred part strength should be achievable without reliance on further deformation resulting during the stamping process. Local regions of any stamped article, such the sharp bends 25 or features such as the license plate pocket 20 shown in the vehicle outer deck lid panel 100 of FIG. 3 may experience significant additional strain during forming. However it is common for large regions in a stamped part, such as horizontal portion 5 of FIG. 3, to experience only minimal strain during forming. Such substantially-undeformed portions of the stamped article, like horizontal portion 5, can only rely on that portion of the cold work remaining in the sheet after exposure to the warm forming process to achieve the preferred part strength goal.

For simplicity the procedure will be first illustrated using another non-aging alloy AA5182-O (nominal composition, by weight: 4-5% Mg; 0.2-0.5% Mn; balance Al and unavoidable impurities), an alloy which has a yield strength of about 130-140 MPa. The choice of 5182-O is illustrative and not limiting and the procedure detailed below is intended to be equally applicable to any of the non-aging aluminum alloys whether they belong to the AA1xxx, AA3xxx, AA4xxx or AA5xxx alloy series.

Once an alloy is selected, AA5182 in this example, a suitable forming temperature is selected. The forming temperature should be selected based on the forming severity of the part and the formability or tensile ductility of the appropriate sheet temper.

When the forming temperature has been selected, the next determination to be made is whether the process recrystallization temperature for the H18 temper is less than or greater than the forming temperature. If the H18 process recrystallization temperature is greater than the forming temperature, the alloy should be used in H18 temper to obtain maximum strengthening due to work-hardening.

If the H18 process recrystallization temperature is less than the forming temperature but the forming temperature is less than the H14 process recrystallization temperature then the alloy should be used in the H14 temper since the alloy, in this temper, will retain most of its strength due to work-hardening and so satisfy the strength requirement.

If the H14 process recrystallization temperature is less than the forming temperature then an H12 temper should still be considered since the lower work hardening of the H12 temper will result in a lower process recrystallization temperature which may be less than the forming temperature. As noted above, 5182 in the H32 temper has yield strength of 235 MPa and so, depending on the process recrystallization temperature, may be capable of satisfying a strength requirement of 165-175 MPa in the formed part. If an HX2 temper, where X is any of temper designations 1, 2, and 3, would not satisfy the formed part strength requirement then there are three options: iteratively select another alloy and repeat the above procedure; select a different forming temperature and repeat the above procedure; or, relax the strength goal to be no less than the strength of the alloy in its 'O' temper to accommodate the alloy under review—5182-O in the present example.

It is also possible that more than one alloy is suitable for forming a particular part. In this circumstance, it may be preferred to select the alloy which develops the highest absolute strength. In some circumstances however, due to, for example, joining, welding or corrosion considerations, a part of lesser absolute strength may be preferred. However if the joining welding or corrosion considerations are directed to an alloy family, such as, for example, 6XXX, rather than to a specific alloy in the alloy family, there may still be some opportunity to maximize strength by suitable choice of specific alloy within the preferred alloy family.

The strength increment attributable to work-hardening may also beneficially contribute to the strength of parts or components which employ age-hardening alloys, i.e. the AA2xxx, AA6xxx, AA7xxx or AA8xxx alloys. However, because conventional processing of these alloys imparts a strength increment due to aging, consideration should also be given to the influence of the process temperature on the aging response of such alloys.

Age hardening alloys are subjected to an elevated temperature solutionizing heat treatment, performed by the supplier, to dissolve at least some portion of the alloying elements in the aluminum matrix and retain these elements in metastable solution at room temperature. Under appropriate time-temperature combinations these metastable solutes will come out of solution and form strengthening precipitates to increase the alloy strength.

Thus, the strength of parts employing age-hardening alloys benefits from a room temperature aging response of the alloy during transit from the supplier, the deformation occurring during stamping, and a second aging response during the paint baking process, typically about 20 minutes at a temperature of about 180° C. or so, used to bake, or set, vehicle paint. At temperatures appreciably greater than about 250° C. or so, overaging occurs, rendering the aging process less effective, or even ineffective in increasing alloy strength.

Thus for work-hardened aging alloys it is preferred to maintain a process temperature of 250° C. or less to maintain significant strength contributions from aging in addition to the additional strength increment due to the retained work hardening. This, of course, further constrains the procedure for choosing an appropriate alloy and alloy temper described above for non age-hardening alloys.

Where the formability of the aging alloy is inadequate to develop the part features by stamping at temperatures of 250° C. and below, it may be appropriate to use a higher temperature. This higher temperature may promote solutionizing the alloy additions so that if the stamped article may be cooled rapidly, for example by forced air cooling, vapor spray or even by thermal communication with cold dies, some of the dissolved alloy may be retained in solution so that a larger aging response may be achieved during the paint bake cycle. These outcomes are shown schematically in FIGS. 1*a-d* and 2*a-d*.

In each of these FIGS. 1*a-d* and 2*a-d*, the yield strength of the alloy, as would be measured in a tensile test, for example, is indicated by the overall height of the bars and the individual contributions to the yield strength are indicated by the individual portions of the bars.

FIGS. 1*a* and 1*b*, schematically illustrate the strength and the strength contributions for a warm-formed, work-hardened sheet of an aging alloy composition at a temperature of less than the process recrystallization temperature. These may be compared with the illustrative data shown at FIGS. 1*c* and 1*d* which show similar data for conventionally-stamped material.

The initially work-hardened sheet will have the strength shown at FIG. 1*a*, comprising a recrystallized base strength 2 (typical of an 'O' temper) to which is added a work-hardening contribution 4. The final part strength, shown at FIG. 1*b* will include a contribution from the base strength after forming 2', as well as further contributions from retained work-hardening 4' and aging 6, 8. The work-hardening contribution 4' shown in FIG. 1*b*, is less than that shown in FIG. 1*a* because of some forming-temperature-induced softening. But, because the warm forming was performed at a temperature suitable for aging of this alloy, there is a contribution to the overall strength from age hardening 6. There is also a yet further increase in strength due to additional age-hardening occurring during paint bake 8 (FIG. 1*b*). It may be noted that the base strength after forming 2' is little different than the recrystallized base strength 2. This is appropriate since, as noted above, the deformation undergone by stamped articles is typically non-uniform and it is not unusual for large portions of any stamped article to undergo minimal deformation and thus, undergo minimal strengthening. Of course, those portions of the stamped article which have undergone appreciable deformation during forming will exhibit yet higher strengths.

The additional hardening occurring during paint baking may be predicted or anticipated based on experience, experiment or modeling and may be considered in determining the strength of the part when selecting suitable age-hardening alloy composition and tempers in practice of the invention.

The evolution in strength of a conventionally-processed alloy ('Prior Art') is shown at FIGS. 1*c*, 1*d*. Initially the alloy has a strength equal to the recrystallized base strength 2 (illustrated at FIG. 1*c*). On forming and undergoing the paint bake cycle, a strength contribution due to age hardening during paint baking, 8' is added to the base strength after forming 2' to result in a final strength represented by the length of the bar shown in FIG. 1*d*. Again, the strength shown is representative of those portions of the stamped article which have undergone minimal deformation, and minimal strengthening, during forming. Comparison of the relative heights of the bars shown at 1*b* and at 1*d* schematically illustrates the strength increase 9, attainable by practice of the methods of this invention.

Figure 2:
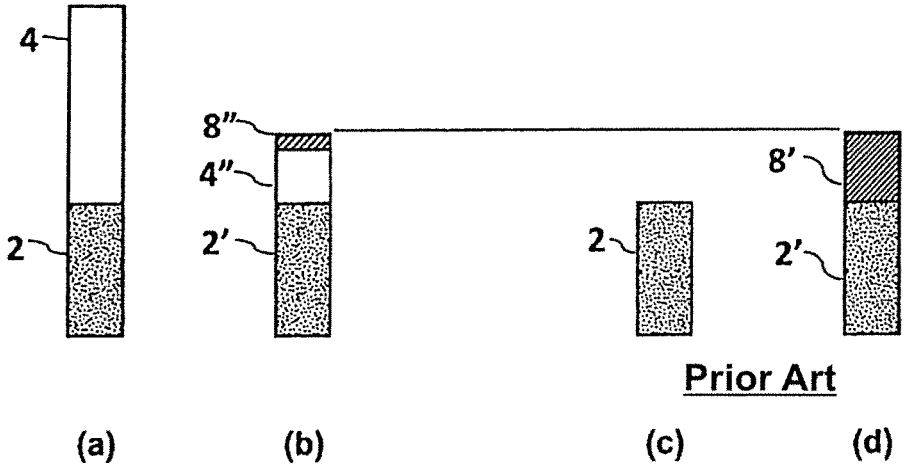
FIGS. 2*a-b* schematically illustrate the yield strength and strengthening contributions obtained when forming a cold rolled, age-hardening alloy composition at a more elevated temperature than that used in FIG. 1. These results are compared with the strength and strengthening contributions obtained with a conventionally stamped alloy shown in FIG. 2*c-d*.

FIGS. 2*a-d* shows a similar comparison for a forming process conducted at a higher temperature. The more elevated temperature significantly decreases the contribution to final part strength (FIG. 2*b*). The work-hardening contribution, 4" is appreciably reduced as is the extent of aging during the paint baking process, 8". However, even in this case, these diminished strength contributions may enable a part strength substantially identical to that obtained conventionally (FIG. 2*d*). In this case it may still be beneficial to follow the described warm forming practice if it will enable simpler, and presumably less costly, upstream processing.

As in the case of the non age-hardening alloys, more than one alloy may be suitable candidate alloy to form the part. Again the final choice of alloy may be informed by considerations of absolute strength, joining, corrosion, or other engineering attributes appropriate to the part and its location and function on the vehicle.

Figure 3:
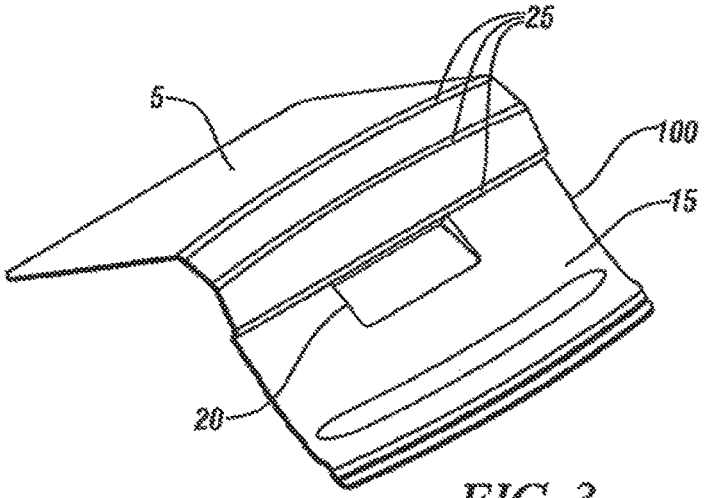
FIG. 3 shows a formed outer deck lid panel in an oblique view.
Figure 4:
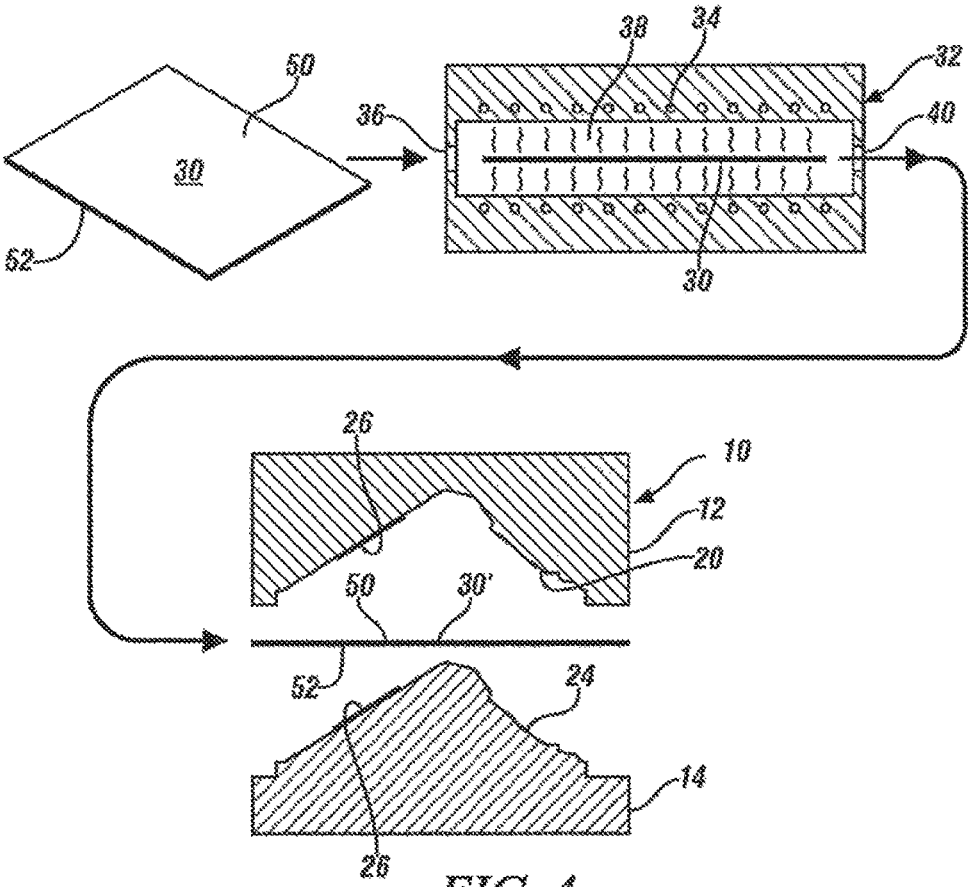
FIG. 4 is a schematic flow diagram of a sheet metal workpiece as it is brought from an inventory area, carried to a heating device where it is preheated to a forming temperature, and then placed between unheated (and, optionally, lubricated) forming dies for shaping into a vehicle body panel such as an outer deck lid panel.

A suitable processing scheme illustrated by reference to a decklid outer panel representative of those stampings which may benefit from practice of the invention is shown in FIGS. 3 and 4. For simplicity, the decklid outer panel is shown as a finished part, that is, after some post-forming processing including trimming excess material to render the intended finished part outline. These post-forming steps do not however modify the formed three-dimensional part shape obtained during forming.

A vehicle outer deck lid panel 100 (FIG. 3) typically has a generally horizontal portion 5 for enclosing the top of a vehicle storage area and a generally vertical portion 15 for enclosing the rear of the storage area and forming a critical rear surface of the vehicle. The vertical surface of the outer deck lid panel often has an indented area 20 for application of a license plate. And both the horizontal and vertical portions of the deck lid panel often have complex curvatures in both their front-to-rear directions and their cross-body directions. Further, as the shape of the metal alloy panel proceeds from its horizontal region to its vertical region, the panel may have ridges 25, or formed sections across the width of the panel, with relatively small radii of curvature. Preferably these ridges or similar ridged features such as the radii associated with indented area 20 will have radii ranging from 1T to 8T, where T is the sheet radius. Thus a 2T radius in a one millimeter thick sheet corresponds to a 2 millimeter radius. It will be appreciated that with such sharp radius bends, areas such as indented region 20, the license plate packet, and ridges 25 are challenging to form.

FIG. 4 illustrates the forming of such a decklid according the practices of the invention. A work-hardened sheet metal workpiece, or blank, 30, usually flat, is conveyed from a supply of such workpieces, located near the forming operation, to a heating oven 32 or other suitable heating device. The sheet metal workpiece 30 may range in thickness from about 0.65 to 6 millimeters and has opposing flat surfaces 50, 52 which will be engaged by the forming surfaces 20, 24 of forming dies 12, 14 of die-set 10. Heating oven 32, as illustrated in FIG. 4, is provided with a heating element 34 to quickly heat workpiece 30 to a specified forming temperature which depends on the part geometry, the forming alloy, and the part strength. The specified forming temperature is determined as described previously. Sheet metal workpiece 30 is conveyed by suitable carrier means (not illustrated) through inlet 36 of the heating oven 32 into the heating chamber 38. Sheet metal workpiece 30 is retained in heating chamber 38 for a specified heating time and is then removed through outlet 40 from the heating oven 32.

Heated workpiece 30' is then promptly placed between the die surfaces 20, 24 of forming dies 12, 14. Typically, transfer of the heated workpiece 30' from heating chamber 38 to die set 10 will be accomplished with little or no delay to minimize any loss of heat during transfer.

Figure 5:
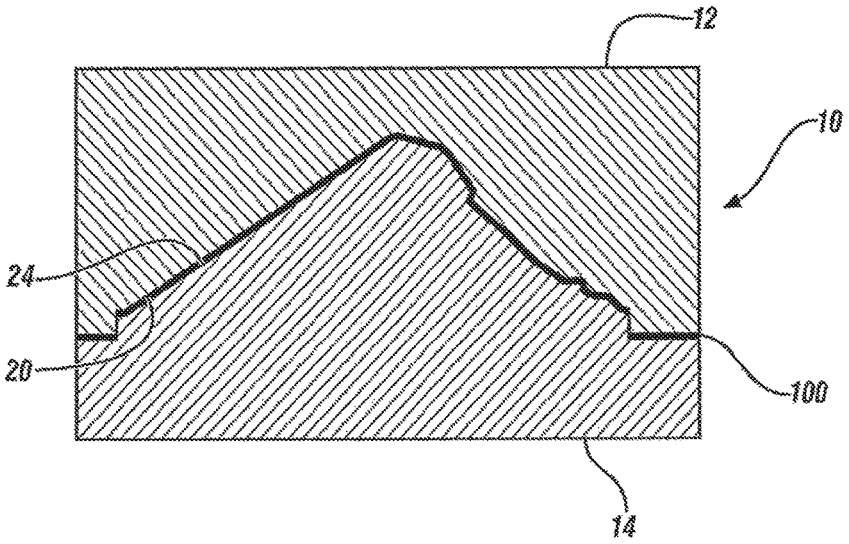
FIG. 5 illustrates, in a cross-section elevation view, the lubricated, unheated, complementary forming dies closed on the heated sheet metal workpiece to form the deck lid outer panel.

One or both of die surfaces 20, 24 may be coated with lubricating film 26 (shown only over a portion of surfaces 20, 24). Alternatively, though less preferred, lubricant may be applied to one or both of sheet surfaces 50, 52. As shown at FIG. 5, dies 12, 14 are mounted in a press (not illustrated), preferably a mechanical press or other suitably fast-closing press to minimize heat loss from the sheet to the dies during forming. Dies 12, 14 are closed by action of their press mechanism against the upper surface 50 and lower surface 52 of heated sheet metal workpiece 30' so that heated workpiece 30' may be formed into outer deck lid panel 100 (FIG. 3) for an automotive vehicle.

It will be appreciated that with a mechanical press equipped with appropriate sheet feeding and stamped article removal mechanisms, it is feasible to rapidly stamp even large articles, such as the decklid shown, at rates as high as 6-10 stampings per minute. It is intended that the production rate of the stamped articles be substantially dictated by the rate of press operation with the transfer of the next workpiece from the heating chamber to the press occurring during forming and transfer of the previous article. At typical production rates using a mechanical press, a cycle time of 6-10 seconds or so for large articles is typical. Thus, a delay of about 6-10 seconds between removal of the heated workpiece from the heating chamber and stamping the part may be anticipated.

By contrast, the heating time for individual sheets is anticipated to be on the order of minutes. Thus it will be appreciated that the single sheet and single furnace shown in the figure is intended only to be illustrative and not representative. Satisfying the rated stamping rate, will require the use of rapid-heating approaches such as induction heating, multiple furnaces in parallel, each capable of processing a single sheet, or, preferably, one or more furnaces capable of storing and heating multiple sheets at one time.

Practice of the invention has been illustrated by its application to aluminum alloys, but those skilled in the art will appreciate that the invention is not limited to only aluminum alloys but may be applied to a wide range of cold worked sheet materials. One suitable sheet material family of automotive interest is magnesium alloys and it is specifically intended that the scope of the invention at least encompass magnesium and magnesium alloy sheet products.

The invention claimed is:

1. A method of forming a sheet metal article of a work-hardened, age hardening light metal alloy composition, the article having a formed shape with a specified ambient temperature yield strength at a specified location in its formed shape, the ambient temperature yield strength of the work-hardened, age hardening light metal alloy composition inherently decreasing over decreasing time periods when exposed to increasing above-ambient temperatures; the method comprising:

providing a sheet metal blank of the work-hardened, age hardening light metal alloy composition for forming the sheet metal article, the sheet metal blank having a thickness in the range of 0.65 mm to 6 mm and having been work-hardened at ambient temperature to have at least the specified ambient temperature yield strength of the formed shape throughout the blank, the work-hardened, age hardening blank being incapable of being formed into the formed shape of the article in a single forming operation at ambient temperature;

uniformly heating the work-hardened, age hardening sheet metal blank to an above-ambient forming temperature, the above-ambient forming temperature being predetermined as suitable for forming of the heated age hardening blank into the formed article shape in a single forming step operation when it is placed between unheated complementary forming dies such that the formed article retains its specified required ambient temperature yield strength;

promptly placing the heated work-hardened, age hardening sheet metal blank between the unheated complementary forming dies and closing the dies to form the article into its intended formed shape in a single forming step;

immediately opening the complementary forming dies and removing the formed article from the complementary forming dies and cooling the formed article to ambient temperature, where the predetermined above-ambient forming temperature is based on the duration of the heating and forming steps so that only partial above-ambient temperature softening of the work-hardened, age hardening light metal alloy occurs and sufficient of the work-hardening of the light metal persists in the formed part to satisfy the formed part specified ambient temperature yield strength requirement.

2. The method of claim 1 in which the work-hardened, age hardening light metal alloy composition is an aluminum alloy or a magnesium alloy work-hardened by cold rolling.

3. The method of claim 2 in which the age hardening aluminum alloy is work-hardened to one of H1X, H2X and H3X tempers where X is a numerical value which may be any one of 1, 2, 3, 4, 5, 6, 7, and 8.

4. The method of claim 3 in which the aluminum alloy is an age-hardening alloy consisting of one of an AA2xxx alloy, an AA6xxx alloy, an AA7xxx alloy, and an AA8xxx alloy.

5. The method of claim 4 in which the temperature and duration of the forming operation are also selected to enhance the formed article yield strength at the specified location by enabling age hardening in the formed article.

6. The method of claim 1 in which the blank is maintained at the predetermined forming temperature for no longer than between 5 and 15 minutes before the article is formed, removed from the forming dies, and cooled.

7. The method of claim 1 in which the cooling is pre-formed by application of forced air or by application of a liquid spray composition.

* * * * *